US006432876B1

(12) United States Patent
Obayashi et al.

(10) Patent No.: US 6,432,876 B1
(45) Date of Patent: Aug. 13, 2002

(54) IMAGE-RECORDING MEDIUM CONTAINING SELF-DEVELOPING LEUCO DYE

(75) Inventors: Tatsuhiko Obayashi; Atsuhiro Ohkawa, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/539,411

(22) Filed: Mar. 30, 2000

(30) Foreign Application Priority Data

Mar. 31, 1999 (JP) ..... 11-093090

(51) Int. Cl.[7] ..... B41M 5/20; B41M 5/24

(52) U.S. Cl. ..... 503/218; 503/222; 503/223; 503/224; 549/330

(58) Field of Search ..... 503/218, 222, 503/223, 224; 549/330

(56) References Cited

U.S. PATENT DOCUMENTS 4,411,452 A * 10/1983 Miyamoto ..... 503/218
5,243,052 A 9/1993 Taylor et al. ..... 546/154

FOREIGN PATENT DOCUMENTS

JP 5-278342 10/1993
JP 11-181031 7/1999

OTHER PUBLICATIONS

Inouye, Masahiko et al, "New Thermo–Response Dyes", Angew.Chem.Int.Ed.Engl.,31 (1992) No. 2 pp. 204–205.

* cited by examiner

*Primary Examiner*—Bruce H. Hess
(74) *Attorney, Agent, or Firm*—Sughrue Mion, PLLC

(57) ABSTRACT

According to the present invention, a coloring property-improved novel leuco dye which can develop color by heat even with single molecule without requiring excess developer can be obtained, and an image recording medium having high sensitivity and excellent resolution effected by including the dye and a high sensitivity image recording medium further combined with an acid generator can also be obtained.

Particularly, it relates to a leuco dye represented by a formula (1) ($LD—(A—P^1)_n$) and to an image recording medium which contains the leuco dye (wherein LD represents an acid-sensitive leuco dye mother nucleus, —A represents the residue of an acidic group (—AH) selected from $—SO_3H$, $—CO_2H$ and $—P(=O)(OH)_xR_y$, R represents a hydrogen atom or a substituent group, x and y are x=1 and y=1 or x=2 and y=0, $P^1$ represents a protecting group which can be removed by the action of light, heat or acid, and n is an integer of 1 or more).

8 Claims, No Drawings

IMAGE-RECORDING MEDIUM CONTAINING SELF-DEVELOPING LEUCO DYE

FIELD OF THE INVENTION

This invention relates to a novel acid-sensitive leuco dye having markedly improved coloring property, to a high sensitivity image-recording medium containing the same and to a high sensitivity chemical amplification type image-recording medium further combined with an acid generator.

BACKGROUND OF THE INVENTION

Leuco dyes which develop color by reacting with acidic developers are broadly used in heat sensitive paper and pressure sensitive paper, and those which develop color in almost all hues such as yellow~orange~red~purple~blue~green~black~near infrared have so far been known. The development of such colors is principally an equilibrium reaction of an acid (developer) and a base (leuco dye), so that an acidic developer such as a bisphenol derivative is generally used in large excess in order to obtain sufficient coloring density.

Since addition of a developer in large excess leads to the increased coating thickness and therefore is disadvantageous in terms of resolution, great concern has been directed toward the improvement of coloring property of leuco dyes and development of a leuco dye capable of developing color with single molecule.

A xanthene based leuco dye in which hydroxyl group is protected with allyl group has been described by M. Inoue et al. in *Angew. Chem. Int. Ed. Engl.,* 31, 204 (1992). When said leuco dye is heated, Claisen rearrangement of allyl group occurs to cause transfer of electron and proton from the thus formed hydroxyl group to the phthalide moiety, thus resulting in the opening of the lactone ring to form a quinoid structure, so that it develops orange color by single molecule without adding a developer.

Also, U.S. Pat. No. 5,243,052 describes a quinophthalone dye protected with t-Boc group. In said compound, hydroxyl group is formed when the protecting group is removed upon heating the compound and bound to the quinoline ring through hydrogen bond, so that it develops a color by itself.

However, these dyes cannot be regarded as techniques which can correspond to every hue and have a disadvantage of being low in heat sensitivity.

On the contrary, there are no reports on the technique for developing color with single molecule by generating an acid group such as carboxyl group, sulfo group or phosphono group in the molecule to form an intramolecular salt.

On the other hand, JP-A-5-281654 (the term "JP-A" as used herein means an "unexned published Japanese patent application") describes a leucoindigo/thioindigo compound which develops color by the removal of t-Boc group, as a leuco dye which develops color by chemical amplification in combination with a photo acid generator.

Also, as a technique in which a leuco dye that develops color by the action of an acidic developer is colored by a chemical amplification system, there are descriptions in U.S. Pat. Nos. 5,286,612, 5,395,736 and 5,441,850, JP-W-8-503081 and JP-W-8-503082 (the term "JP-W" as used herein means an "unexamined published Japanese international patent application"), regarding recording materials in which a secondary acid generator which generates a secondary acid (developer) by the action of a superacid generator and a superacid is used in combination with a leuco dye. In this case, a developer (secondary acid) is generated by an amplified manner in an amount sufficient enough for developing color of the leuco dye when heated, only in a region where an actinic ray is applied, and the color is developed by its interlayer mixing with the leuco dye coated on another layer.

Recording materials which use such an acid amplification have a problem in that their sensitivity is reduced in the case of a leuco dye having a basic group such as amino group which inhibits acid amplification.

For example, the former leucoindigo compound is low in sensitivity due to the action of nitrogen atom to inhibit acid amplification, and the latter case requires coating of the secondary acid generator and leuco dye on different layers.

Though most of the leuco dyes which develop cyan~black colors have amino group, a spiropyran compound has been disclosed as a structure which does not have amino group but develops color by an acidic developer, for example in JP-A-49-2545, JP-A-57-191634, JP-A-60-27589, JP-A-63-41846 and British Patent 1,359,472. The present inventors have found that acid amplification inhibition of this compound was small, but its coloring property by the acidic developer was low, so that further improvement was required because of the necessity to use large excess of the developer in order to obtain sufficient coloring density.

In addition, great concern has been directed toward the development of a leuco dye which shows low acid amplification inhibition, does not require a developer and develops blue color by itself.

SUMMARY OF THE INVENTION

The object of the present invention is to provide first a leuco dye having improved coloring property, which develops color even by single molecule without requiring excess amount of a developer, secondly an image-recording medium which contains the same to effect high sensitivity and excellent resolution and thirdly an image-recording medium which shows high sensitivity even in an image forming method in which an acid generator is used.

The object of the present invention has been achieved by the following items 1) to 8).

1) An image-recording medium which comprises a leuco dye represented by the following general formula (1):

$$\mathrm{LD}\text{—}(\mathrm{A}\text{—}\mathrm{P}^1)_n \qquad (1)$$

wherein LD represents an acid-sensitive leuco dye mother nucleus, —A represents the residue of an acidic group (—AH) selected from $—SO_3H$, $—CO_2H$ and $—P(=O)_xR_y$, R represents a hydrogen atom or a substituent group, x and y are x=1 and y=1 or x=2 and y=0, $P^1$ represents a protecting group which can be removed by the action of light, heat or acid, and n is an integer of 1 or more.

2) The image-recording medium according to the above item 1), wherein LD is a spiropyran derivative.

3) The image-recording medium according to the above item 1) or 2) , wherein the leuco dye of general formula (1) has apolymerizable group at a substitutable position and is forming a copolymer with a monomer having a partial structure which generates acid by the action of light, heat or acid.

4) The image-recording medium according to any one of the aforementioned items 1) to 3), wherein it further comprises an acid generator which generates acid by the action of light or heat.

5) The image-recording medium according to any one of the aforementioned items 1) to 4), wherein it further comprises a compound which newly generates acid by the action of acid.

6) The image-recording medium according to any one of the aforementioned items 1) to 5), wherein it further comprises an infrared absorbing substance.

7) A leuco dye represented by the aforementioned general formula (1).

8) A leuco dye according to the above item 7), wherein LD is a spiropyran derivative.

Other objects and advantages of the present invention will be made apparent as the description progresses.

DETAILED DESCRIPTION OF THE INVENTION

In the general formula (1), ID represents a colorless or hypochromic acid-sensitive leuco dye mother nucleus which develops color by reacting with an acidic developer. Known leuco dyes are described in detail in, for example, Moriga and Yoshida, "Dyes and Drugs" (written in Japanese), 9, p. 84 (Chemical and Synthetic Industry Association, 1964); "New Edition Dye Handbook" (written in Japanese) ,p. 242 (Maruzen, 1970); R. Garner, "Reports on the Progress of Appl. Chem.", 56, p. 199 (Maruzen, 1974); "Memory, Recording and Sensitive Materials" (written in Japanese), p. 144 (Gakujutsu Publication Center, 1985; and U.S. Pat. Nos, 5,243,052 and 4,826,976.

Acid-sensitive leuco dyes are broadly used in pressure sensitive paper and heat sensitive paper, and those which develop color in almost all hues such as yellow~orange~red~purple~blue~green~black~near infrared have so far been known. From the structural point of view, those which have various nuclei are also known, such as of a diaryl phthalide series, a fluoran series, a bisindolyl phthalide series, an arylindolyl phthalide series, an arylindolyl azaphthalide series, an acylleucoazine series, a leucoauramine series, a spiropyran series, a rhodamine lactam series, a leucotriarylmethane series, a diarylchromene series and a styryl series.

Among them, a type which develops color by ring-opening of the leuco dye by the action of acid is particularly useful in the present invention.

When the image-recording medium of the present invention is an acid-amplifying type image-recording medium which comprises a leuco dye and an acid generator, it is desirable that the leuco dye mother nucleus is not substituted with amino group which inhibits acid amplification, and a spiropyran mother nucleus can be exemplified as particularly preferred blue color developing mother nucleus.

The leuco dye to be used in the present invention is characterized in that at least one acidic group precursor (—A—$P_1$) which forms an acidic group (—AH) in the molecule by the action of light, heat or acid is located at a substitutable position, and since the acidic group formed in the molecule act as a developer, good coloring property can be obtained without adding a developer.

In the general formula (1), —A represents the residue of an acidic group (—AH) selected from —$SO_3H$, —$CO_2H$ and —$P(=O)(OH)_xR_y$, wherein R is a hydrogen atom or a substituent group, and x and y are x=1 and y=1 or x=2 and y=0.

When R is a substituent group, it may be a substitutable group but is preferably an alkyl group (e.g., methyl group, ethyl group or i-propyl group) or an aryl group (e.g , phenyl group, p-chlorophenyl group or naphthyl group), particularly preferably an alkyl group.

According to the present invention, a case in which A is —$SO_3$— or —$CO_2$— is particularly desirable.

In the general formula (1), $p^1$ represents a protecting group of the aforementioned acidic group (—AH), which can be removed by the action of light, heat or acid. Various examples of such a protecting group are described, for example, in R. Taylor, "Chemistry of Carboxylic Acids and Derivatives (S. Patai Editor)", Chapter 15, p. 859 (Wiley, New York, 1979); and Theodra W. Green, "Protective Groups in Organic Synthesis". Also can be exemplified are various substituent groups of acidic groups in compounds (acid generators) which generate acid by the action of light or heat (e.g., 2-nitrobenzyl group, benzoin group, various oniums and a group which leaves an organic acid by β-hydrogen removal) , described, for example, in "Organic Materials for Imaging" (written in Japanese), edited by Organic Electronics Material Association (Bunshin Shuppan), pp. 187–198 (1993) and substituent groups of acidic groups in compounds (acid amplifiers) which amplify acid by the action of acid (e.g., a group which leaves an organic acid by electron transfer or intramolecular nucleophilic substitution reaction after decomposition, for example, of t-butyl ester by an acid catalyst, a group which leaves an organic acid by β-removal after acid catalyst decomposition of acetal or ketal and a group which leaves an organic acid by pinacol rearrangement in the presence of an acid catalyst), described in K. Ichimura, "Chem. Lett.", p. 551 (1995) and JP-A-8-248561.

According to the present invention, preferred examples of the protecting group of carboxyl group or phosphono group include a secondary or tertiary alkyl group having hydrogen atom at the β-position (e.g., t-butyl group, cyclohexyl group or isopropyl group), an alkoxymethyl group (e.g., methoxymethyl group, octyloxymethyl group, benzyloxymethyl group, methoxyethoxymethyl group, tetrahydropyranyl group or tetrahydrofuranyl group), a silyl group (e.g., trimethylsilyl group, triethylsilyl group, t-butyldimethylsilyl group or phenyldimethylsilyl group) and the substituent groups of acidic groups in the aforementioned acid generators or acid amplifiers, of which particularly preferred are a tertiary alkyl group having hydrogen atom at the β-position, an alkoxymethyl group, a silyl group and a substituent group of acidic group in the aforementioned acid generator or acid amplifier.

According to the present invention, a secondary alkyl group (e.g., cyclohexyl group, isopropyl group or 2-cyclohexenyl group) and the substituent group of acidic group in the aforementioned acid generator or acid amplifier can be cited as particularly preferred examples of the protecting group of sulfo group.

In the general formula (1) , n is an integer of 1 or more. Though the upper limit is not particularly limited, n is preferably from 1 to 5, particularly preferably from 1 to 3.

According to the present invention, the aforementioned acidic group precursor may be substituted at any substitutable position of the leuco dye mother nucleus ID. However, a copolymer of a leuco dye monomer unsubstituted by the acidic group precursor with an acid-generating monomer is excluded. The substitution number n of acidic group precursors in one molecule may be two or more, and when n is two or more, the —A—$P^1$ which is present in plural numbers may be the same or different from one another. The coloring property is improved when the substitution number is increased as a matter of course, but sufficient coloring effect can be obtained even by one substitution.

The leuco dye represented by the general formula (1) may form a polymer through the connection of a plurality of polymerizable groups introduced into substitutable positions. Then a polymer is formed, coating ability is obtained without using a binder, so that it is advantageous from the viewpoint of thinning the image recording layer. Mblecular weight of the polymer is within the range of preferably from 1,000 to 1,000,000, more preferably from 2,000 to 300,000. In this case, it may be a homopolymer or a copolymer with other monomer.

According to the present invention, in order to further increase the sensitivity, it may form a copolymer with a monomer having a partial structure which generates acid by the action of light, heat or acid (those which are described in the aforementioned documents relating to acid generators or acid amplifiers can be cited as its examples) In that case, the copolymerization ratio of leuco dye monomer/acid-generating monomer is within the range of preferably from 100/1 to 1/20, particularly preferably from 20/1 to 1/5.

In addition, in order to add absorption characteristics, a monomer having the leuco dye structure described in the present invention may form a copolymer with another monomer having, as its partial structure, the structure of other leuco dye which develops color by the action of heat or acid (e.g., those which are described in JP-A-4-124175, JP-A-5-278342, JP-A-6-227139, JP-A-5-281654, JP-A-5-294977, JP-A-6-255256, U.S. Pat. Nos. 4,602,263 and 4,826,976).

The following shows illustrative examples of leuco dye useful in the present invention, though the invention is not restricted thereby.

(1)

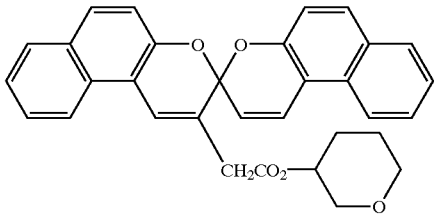

(2)

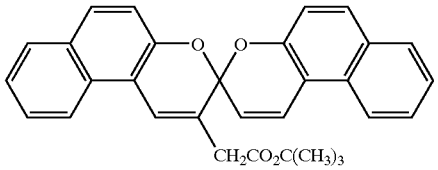

(3)

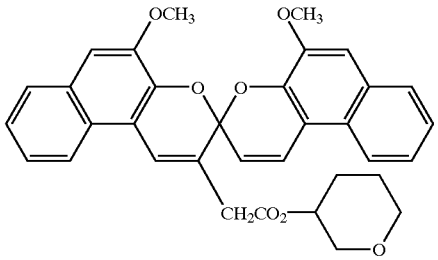

(4)

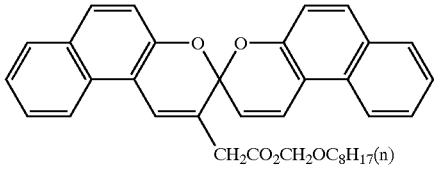

(5)

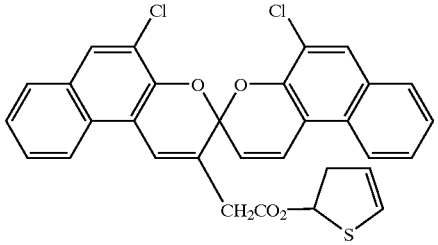

-continued
(6)
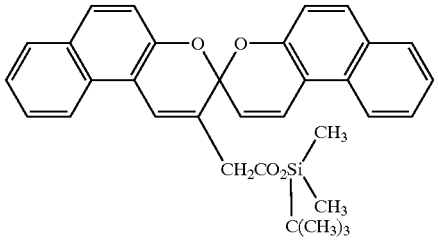
(7)
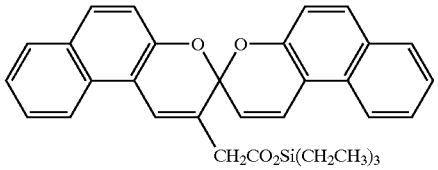
(8)
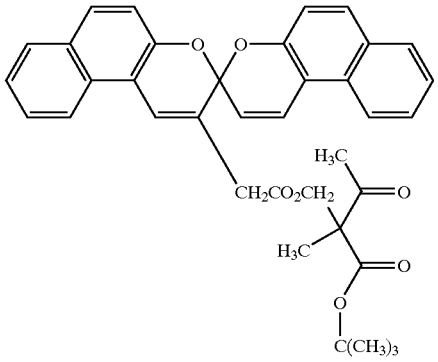
(9)
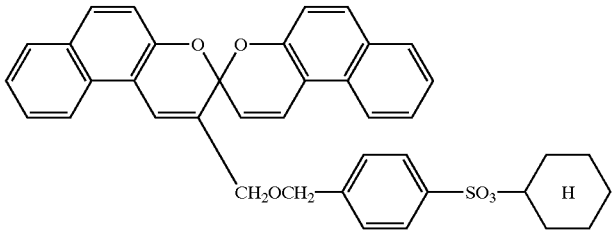
(10)
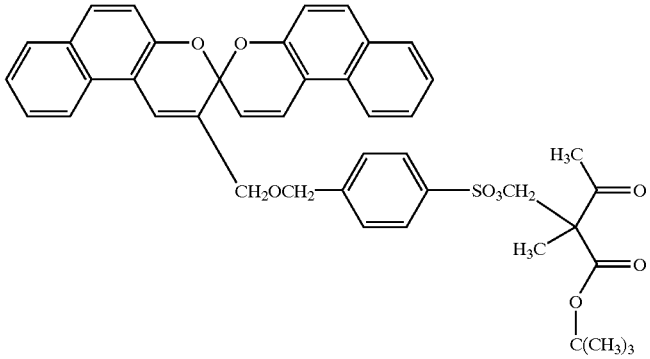
(11)
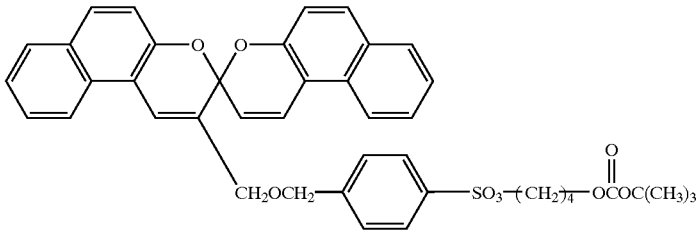

-continued
(21)
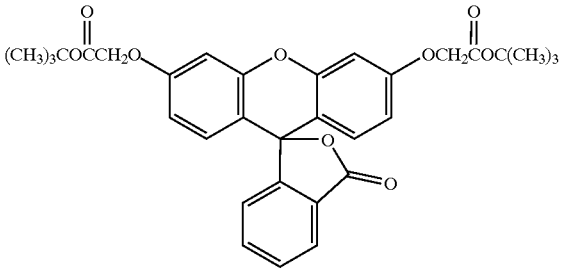
(22)
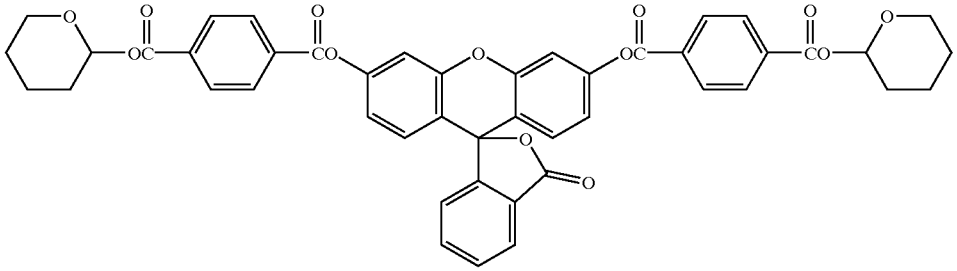
(23)
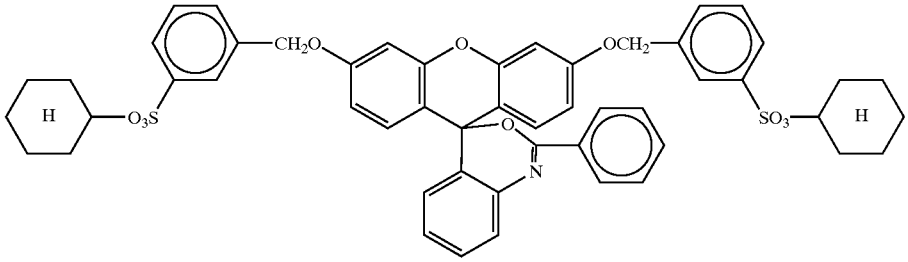
(24)
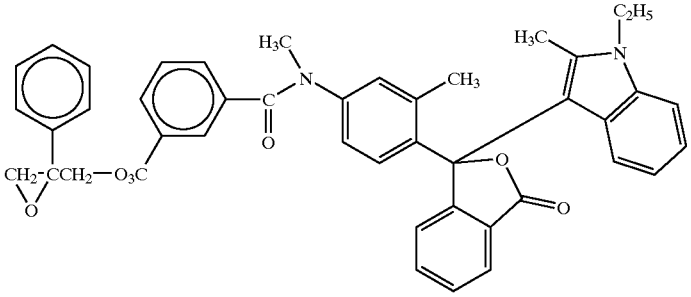
(25)
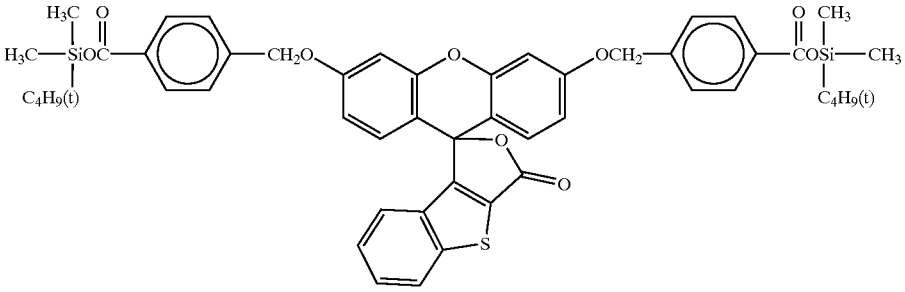
(26)
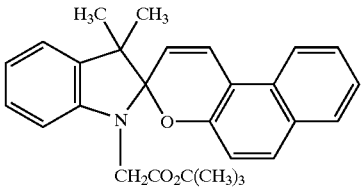

-continued
(27)
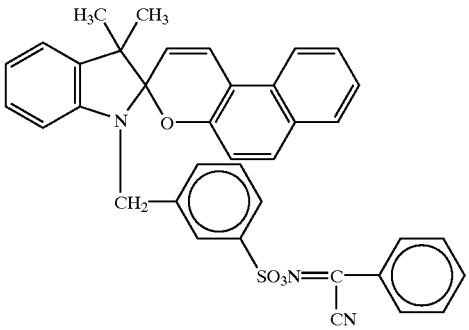
(28)
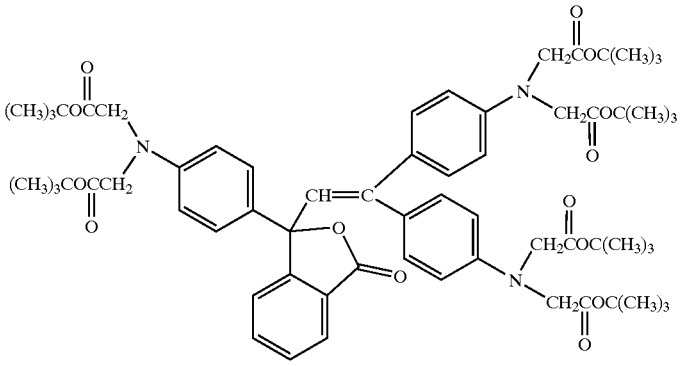
(29)
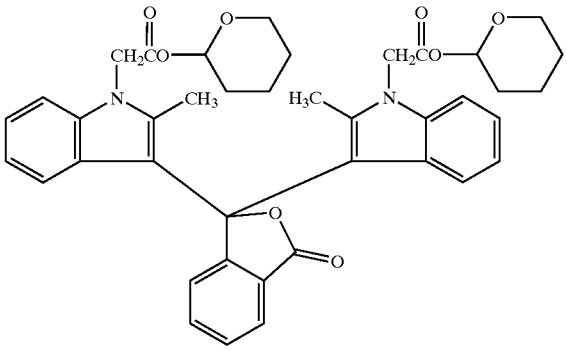
(30)
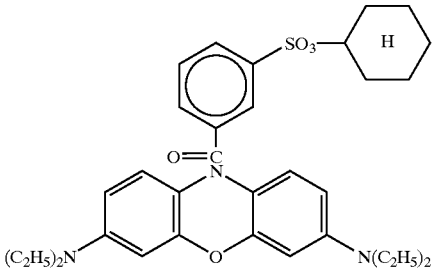
(31)
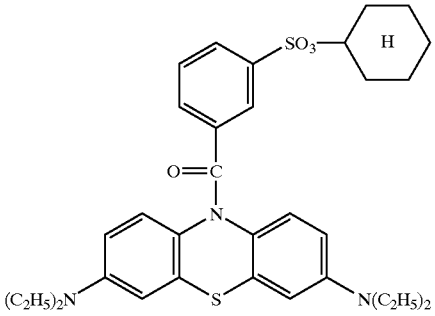

-continued
(32)
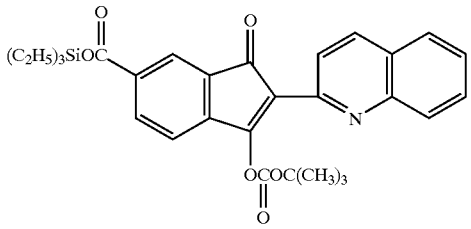
(33)
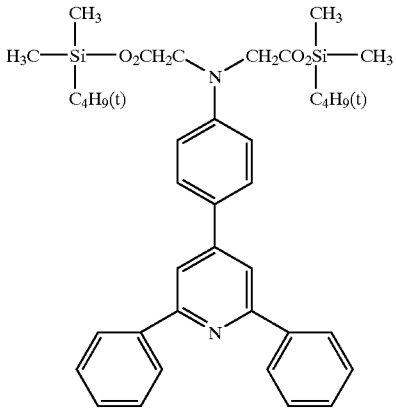
(34)
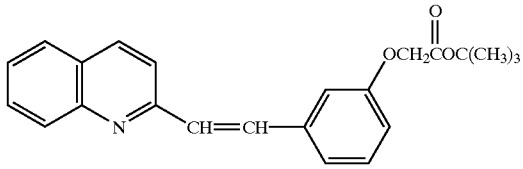
(35)
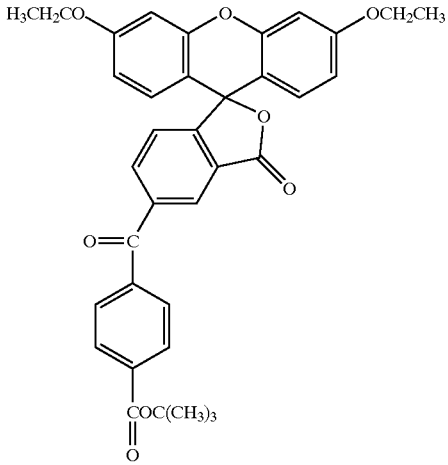
(36)
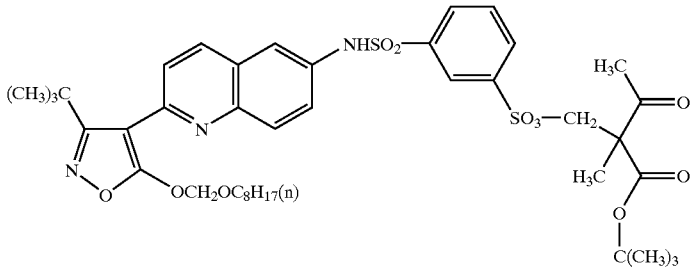

-continued
(37)
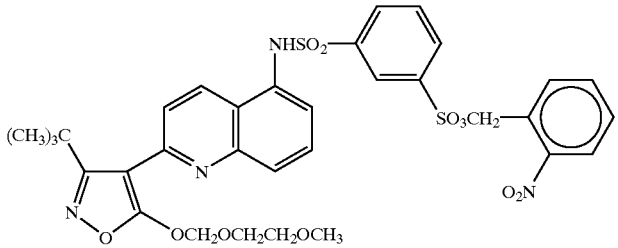
(38)
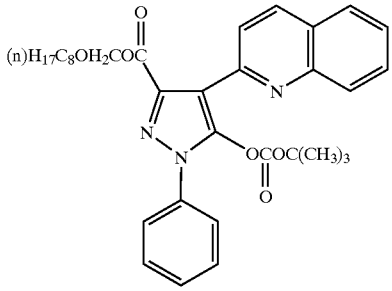
(39)
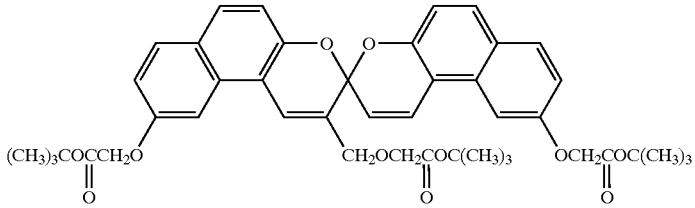
(40)
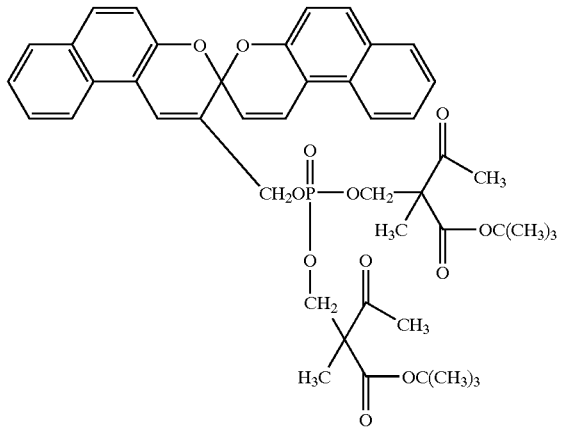
(41)
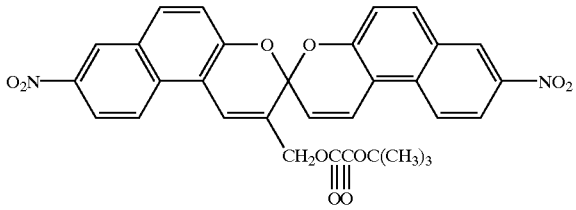

-continued
(42)
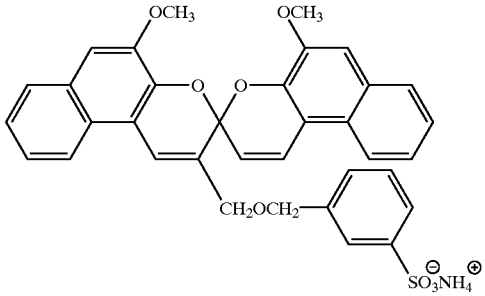
(43)
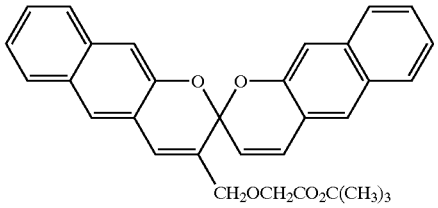
(44)
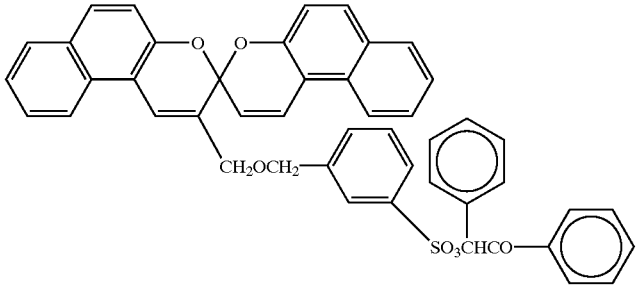
(45)
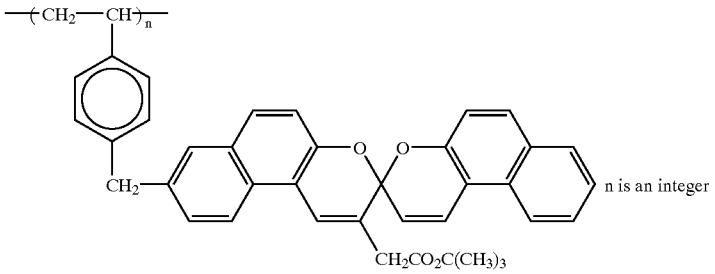
(46)
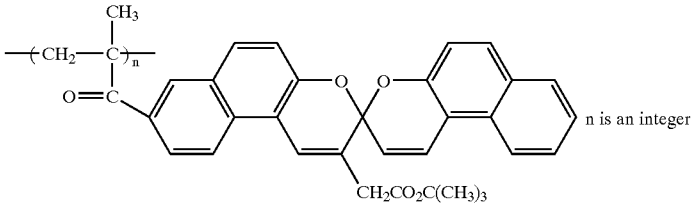
(47)
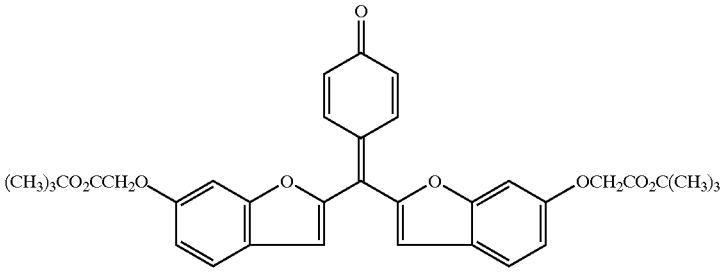

-continued
(48)
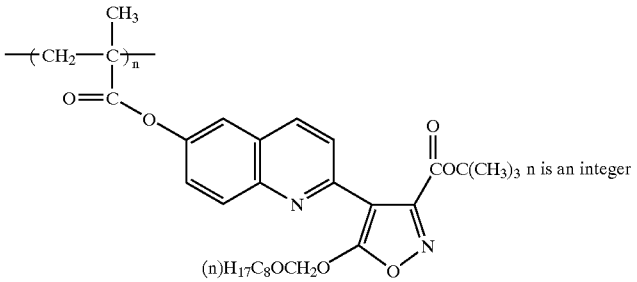
(49)
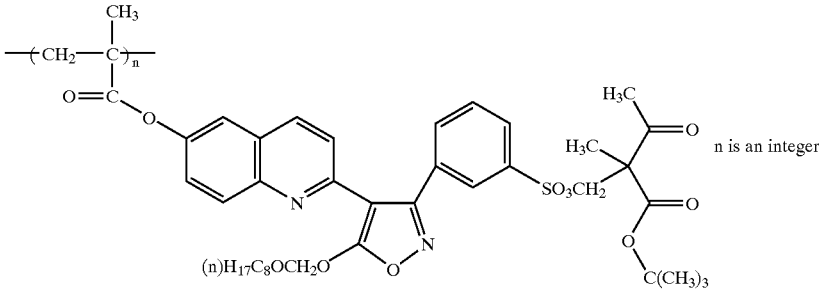
(50)
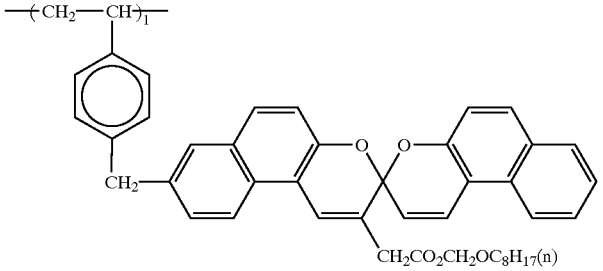
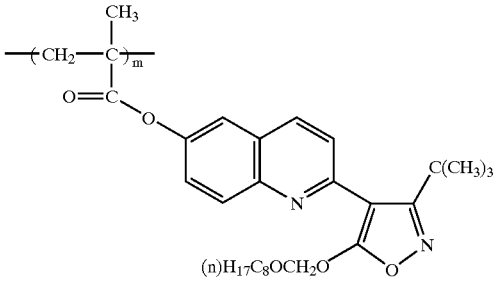
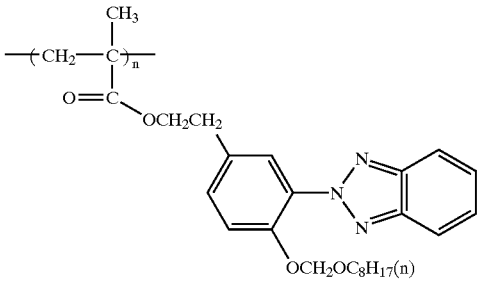
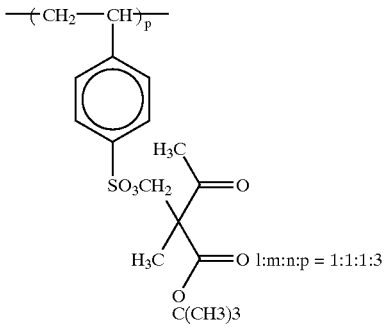

-continued (51)

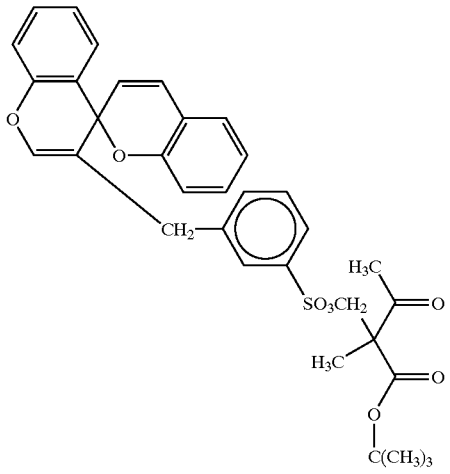

(52)

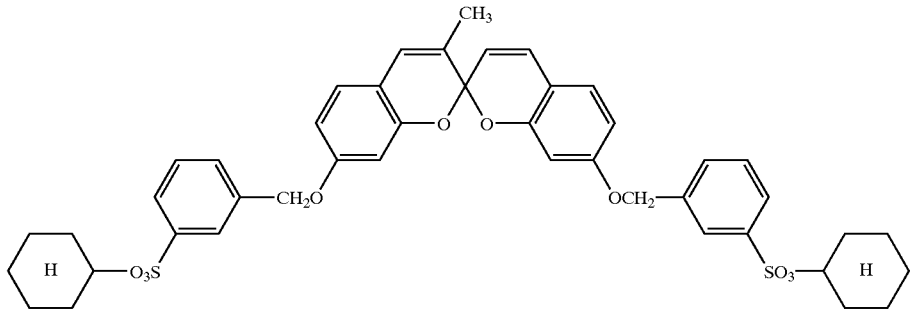

(53)

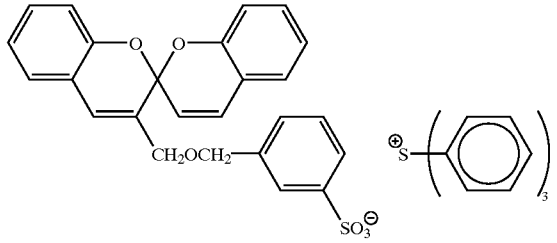

(54)

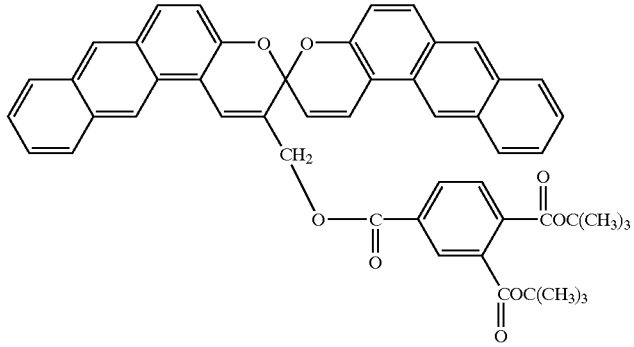

The leuco dye of the present invention represented by the general formula (1) can be synthesized by employing known leuco dye synthesis methods (described in detail for example by H. Horiguchi in "Synthetic Dye Review" (written in Japanese), edited by Sankyo Shuppan (1968); also, spiropyran mother nucleus is described for example by W. Dilthey et al. in *J. Prakt. Chem.,* vol. 114, p. 187 (1926), by C. F. Kolesch et al. in *J. Am. Chem. Soc.,* vol. 74, p. 6288 (1952) and by I. M. Heilbron et al. in *J. Chem. Soc.,* p. 1571 (1934)).

For example, regarding the illustrative compound (1), it can be synthesized by synthesizing corresponding ethyl ester compound from ethyl 3-oxobutanoate and 2-hydroxy-1-naphthoaldehyde under introduction of hydrochloric acid gas, hydrolyzing the synthesized ester and then allowing the resulting carboxylic acid to react with dihydropyran in the presence of p-toluenesulfonic acid catalyst. In the same manner, the illustrative compounds (2) to (8) can also be synthesized by applying known protecting group-introducing methods to the carboxylic acid intermediate.

The leuco dye polymer of the present invention can be obtained by polymerizing the leuco dye monomer synthesized making use of the just described method, for example by solution polymerization, precipitation polymerization, suspension polymerization, bulk polymerization or emulsion polymerization. Examples of the polymerization initiation method include a method in which a radical initiator is used and a method in which a light or radial ray is irradiated. These polymerization methods and polymerization initiation methods are described for example in T. Tsuruta, "High Polymer Synthesis Methods (written in Japanese)" (revised edition, publishedbyNikkan Rogyo Shinbun, 1971) and T. Ohtsu and M. Kinoshita, "Experimental Methods for High Polymer Synthesis (written in Japanese)", published by Kagaku Dohjin in 1972, pp. 124–154.

The polymerization temperature should be determined in relation, for example, to molecular weight of the polymer to be formed and kind of the initiator and is within the range of possibly from not higher than 0 to not lower than 100° C., but generally from 30 to 100° C. Since there is a possibility of causing decomposition of the leuco dye monomer at higher temperature, it is desirable to carry out the polymerization at a temperature of from 30 to 80° C. in the case of this invention.

Preferred examples of the radical initiator to be used in the polymerization include azo series initiators such as 2,2'-azobisisobutyronitrile, 2,2'-azobis(2,4-dimethylvaleronitrile), 2,2'-azobis(2-amidinopropane) dihydrochloride and 4,4'-azobis (4-cyanopentanoic acid) and peroxide series initiators such as benzoyl peroxide, t-butyl hydroperoxide and potassium persulfate (which may also be used as a redox initiator in combination with sodium hydrogen sulfite).

Amount of the polymerization initiator to be used can be adjusted in response to the polymerizing ability of monomers and molecular weight of the desired polymer and is preferably within the range of from 0.01 to 5.0 mol % based on the monomers.

Synthesis of the copolymer of the present invention may be effected by firstly mixing the leuco dye monomer with a monomer to be copolymerized, such as an acid-generating monomer, in a reaction vessel and then adding an initiator to the vessel, or by carrying out the polymerization via a step in which these monomers are added dropwise to a polymerization solvent.

According to the image recording medium of the present invention, a compound which generates acid by the action of light or heat can be used together with the leuco dye of general formula (1). Various examples of such a compound are described in the aforementioned dents in relation to the description of $P^1$ in the general formula (1), and all of them can be used in this invention When a thermal acid generator is used, a compound which amplifies heat by its exothermic decomposition, such as nitrocellulose, may be added as a sensitizer, and when a photo acid generator is used, various sensitizers (e g., those which are described for example in *J Polymer. Sci.,* 16, 2441 (1987)) may be added in order to expand the photosensitive range.

Sensitivity and storage stability of the recording material can also be controlled by adjusting the amount of these acid generators to be added, which is generally within the range of preferably from 0. 001 to 20 equivalents, particularly preferably from 0.01 to 5 equivalents, based on the leuco dye.

According to the image recording medium of the present invention, a compound which newly generates acid by the action of an acid generated from a photo acid generator or a thermal acid generator can be used. Examples of such a compound are described in the aforementioned documents related to the description of $P^1$ in the general formula (1), and all of them can be used in the present invention. A case in which the acid generator itself also has an acid-amplifying function is particularly preferable in the present invention.

In general, these compounds which further generate acid by the action of acid are used in an amount of preferably from 0 1 to 20 equivalents, more preferably from 0.5 to 5 equivalents, based on the aforementioned leuco dye.

The image recording medium of the present invention is prepared generally by coating a support with the aforementioned leuco dye and, as occasion demands, an acid generator and a compound which further generates acid by the action of acid. In that case, a binder is allowed to coexist in general, except for a case in which any one of these compounds is a polymer or in the amorphous form having high coating ability. Also, in order to obtain desired absorption characteristics for each purpose, other leuco dye which develops color by the action of heat or acid (e g., those which are described in JP-A-4-124175, JP-A-5-278342, JP-A-6-227139, JP-A-5-281654, JP-A-5-294977, JP-A-6-255256, U.S. Pat. Nos. 4,602,263 and 4,826,976) may also be allowed to coexist. Also, in order to improve storage stability of the image recording medium, a small amount of a base may be added, or various additives such as a pigment, an antioxidant and a sticking inhibitor may be added as occasion demands. In addition, an overcoat layer may be arranged in order to protect the image forming layer, or a back-coat layer may be arranged on the backside of the support. In this connection, various known techniques for image recording media can be used, such as the arrangement of a single or multiple undercoat layer comprised of a pigment or resin between the image forming layer and the support.

When a base is added, it is desirable to use an organic base, and its preferred examples include a guanidine derivative (e.g., 1,3-diphenylguanidine, 1,3-dimethylguanidine, 1,3-dibutylguanidine, 1-benzylguanidine or 1,1,3,3-tetramethylguanidine), an aniline derivative (e.g., aniline, p-t-butylaniline, N,N'-dimethylaniline, N,N'-dibutylaniline or triphenylamine), an alkylamine derivative (e .g., tributylamine, octylamine, laurylamine, benzylamine or dibenzylamine) and a heterocyclic compound (e g., N,N'-dimethylaminopyridine, 1,8-diazabicyclo[5.4 0]-7-undecene, triphenylimidazole, lutidine or 2-picoline). These bases are added in an amount of preferably from 0.01 to 100 mol %, particularly preferably from 0.1 to 20 mol %, based on the acid generator.

Examples of useful binder include water-soluble binders such as gelatin, casein, starches, hydroxyethyl cellulose, carboxymethyl cellulose, polyvinyl alcohol, polyacrylamide and ethylene-maleic anhydride copolymer and water-insoluble binders such as polyvinyl butyral, triacetyl cellulose, polystyrene, methyl acrylate-butadiene copolymer and acrylonitrile-butadiene copolymer.

When a pigment is used, diatomaceous earth, talc, kaolin, sintered kaolin, titanium oxide, silicon oxide, magnesium carbonate, calcium carbonate, aluminum hydroxide and urea-formalin resin can be cited as its examples.

Examples of other additives include ultraviolet absorbers such as of benzophenone and benzotriazole series, head abrasion and sticking inhibitors comprised of higher fatty acid metal salts such as zinc stearate and calcium stearate and waxes such as paraffin, paraffin oxide, polyethylene, polyethylene oxide and castor wax, and these additives may be added as occasion demands.

Examples of the support to be used in the image recording medium of the present invention include papers such as wood-free paper, baryta paper, coat paper, cast-coated paper and synthetic paper and polymer films such as of polyethylene, polypropylene, polyethylene terephthalate, polyethylene-2,6-naphthylene dicarboxylate, polyallylene, polyimide, polycarbonate and triacetyl cellulose, as well as glass, metal foil and non-woven fabric.

A transparent support is used when the image recording medium of the present invention is applied to transmission type image uses such as OHP films and process films. Also, when used in process films, a support which has small coefficient of thermal expansion and excellent dimensional stability and does not have absorption in the photosensitive region of PS plate is selected.

A heat mode image recording is carried out when the acid generator contained in the image recording medium of the present invention is a compound which generates acid by the action of heat. In that case, examples of the heating method as image forming means include a method in which the recording material is contacted with a heated block or plate, a method in which it is contacted with a hot roller or hot drum, a method in which it is irradiated with a halogen lamp or infrared or far infrared lamp heater, a method in which it is imagewise heated with the heating head of a thermal printer and a method in which it is irradiated with laser beam, of which the laser beam irradiation method is desirable when a high resolution is required such as the case of plate making material applications. Also, in order to effect formation of images with more smaller thermal energy, the heat sensitive recording material of the present invention may be heated in advance to an appropriate temperature.

When images are formed by laser beam irradiation, it is necessary to include a dye which absorbs a light of the wave length of laser beam for the purpose of converting said laser beam into thermal energy Examples of the laser beam source include excimer laser, argon laser, helium neon laser, semiconductor laser, glass (YAG) laser, carbon dioxide laser and dye laser, of which helium neon laser, semiconductor laser and glass laser are useful laser sources of the present invention. Among them, the semiconductor laser is particularly useful because of the small and inexpensive apparatus. Since the oscillation wave length of semiconductor laser is generally from 670 to 830 nm, a dye having an absorption at said near infrared is used. Examples of the near infrared-absorbing dye to be used include cyanine dye, squalilium dye, merocyanine dye, oxonol dye and phthalocyanine dye. Their illustrative examples include those which are described in U.S. Pat. Nos. 4,973,572, 4,948,777, 4,950,640, 4,950,639, 4,948,776, 4,948,778, 4,942,141, 4,952,552, 5,036,040 and 4,912,083.

According to the present invention, images can be amplified by effecting imagewise generation of an acid catalyst from the thermal acid generator by the aforementioned heating method and then carrying out overall heating. In that case, it is essential that the overall heating is carried out at such a temperature that decomposition of the acid generator does not occur in the non-image parts and that, when applied to plate making materials, dimensional stability of the support can be guaranteed. According to the present invention, the heat developing temperature is within the range of preferably from 60 to 150° C., more preferably from 80 to 120° C.

When the acid generator included in the image recording medium of the present invention is a compound which generates acid by the action of light, the laser beam source is selected in response to the absorption wave length of said acid generator or of a sensitizer added to expand the photosensitive region. Heat developing after the laser exposure can be carried out in the same manner as the case of the use of the thermal acid generator.

Examples of the present invention are given below by way of illustration and not by way of limitation.

A typical synthesis example of a leuco dye of the present invention represented by the general formula (1) is shown in the following. Other leuco dyes can also be synthesized in the same manner by introducing an acid sensitive protecting group into a carboxylic acid, sulfonic acid or phosphoric acid derivative by usually used means.

Synthesis Example

Synthesis of Illustrative Compound (4)

A 1.5 g portion of 3-carboxymethyl-di-β-naphthospiropyran (the compound described in British Patent 1,359,472) was dissolved in 7.5 ml of tetrahydrofuran, and the solution was mixed with 150 mg of sodium hydride dispersed in oil (content 60%).

This was further mixed with 0.72 ml of chloromethyl octyl ether and stirred at room temperature for 1 hour. The reaction solution was nixed with ethyl acetate and washed with water, and the organic layer was extracted, dried with magnesium sulfate and then concentrated.

When the thus obtained oily substance was purified a silica gel column chromatography (developing solvent; n-hexane/ethyl acetate=5/1), 1.2 g of the illustrative compound (4) was obtained as a light yellow oily substance. Its structure was identified by $^1$H-NMR.

$^1$H-NMR ($CDCl_3$) δ (ppm): 0.83 (3H), 1.2 (10H), 1.2 –1.8 (2H), 3.5 (2H), 3.55 (2H), 5.28 (2H), 6.2 (1H), 7.0 (2H), 7.2–7.9 (10H), 8.12 (2H)

EXAMPLE

The following compounds were dissolved in chloroform, and the solution was coated on a polyethylene terephthalate film having a thickness of 100 μm and then dried to prepare a transparent image recording sheet. As the polystyrene, polystyrene beads (diameter; about 3.2 mm) manufactured by Wako Pure Chemical Industries were used.

Sample-1

| | |
|---|---|
| Illustrative compound (4) | 1 mmol/m$^2$ |
| Acid generator | 2 mmol/m$^2$ |
| IR dye | 113 mg/m$^2$ |
| Polystyrene | 2.2 g/m$^2$ |

Sample-2

| | |
|---|---|
| Illustrative compound (10) | 1 mmol/m$^2$ |
| IR dye | 113 mg/m$^2$ |
| Polystyrene | 2.2 g/m$^2$ |

Sample-3

| | |
|---|---|
| Illustrative compound (10) | 1 mmol/m$^2$ |
| Acid generator | 2 mmol/m$^2$ |
| IR dye | 113 mg/m$^2$ |
| Polystyrene | 2.2 g/m$^2$ |

Sample-4

| | |
|---|---|
| Illustrative compound (20) | 1 mmol/m$^2$ |
| IR dye | 113 mg/m$^2$ |
| Polystyrene | 2.2 g/m$^2$ |

Sample-5

| | |
|---|---|
| Illustrative compound (21) | 1 mmol/m$^2$ |
| IR dye | 113 mg/m$^2$ |
| Polystyrene | 2.2 g/m$^2$ |

Sample-6

| | |
|---|---|
| Illustrative compound (21) | 1 mmol/m$^2$ |
| Acid generator | 2 mmol/m$^2$ |
| IR dye | 113 mg/m$^2$ |
| Polystyrene | 2.2 g/m$^2$ |

Reference Sample-1

| | |
|---|---|
| Reference compound-1 | 1 mmol/m$^2$ |
| Acid generator | 2 mmol/m$^2$ |
| IR dye | 113 mg/m$^2$ |
| Polystyrene | 2.2 g/m$^2$ |

Reference Sample-2

| | |
|---|---|
| Reference compound-2 | 1 mmol/m$^2$ |
| Acid generator | 2 mmol/m$^2$ |
| IR dye | 113 mg/m$^2$ |
| Polystyrene | 2.2 g/m$^2$ |

Reference Sample-3

| | |
|---|---|
| Reference compound-3 | 1 mmol/m$^2$ |
| IR dye | 113 mg/m$^2$ |
| Polystyrene | 2.2 g/m$^2$ |

Acid generator

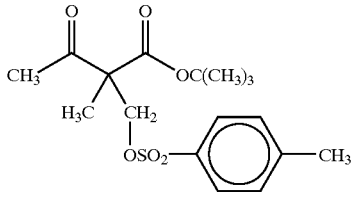

IR dye

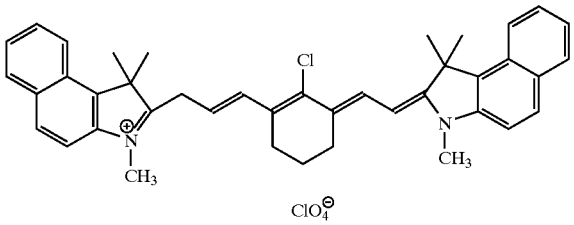

Reference compound-1

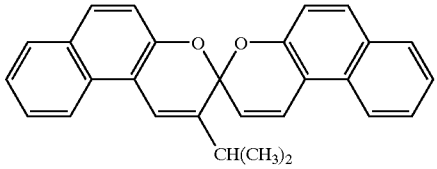

Reference compound-2

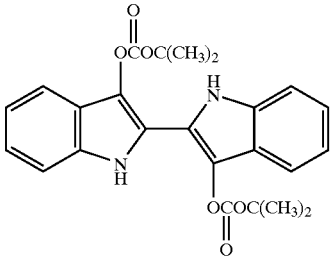

Reference compound-3

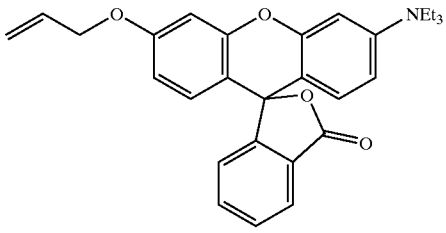

(Compound described in *Angew. Chem. Int. Ed. Engl.,* 31, 204 (1992))

<Laser Exposure Conditions for Image Recording>

A total of 8 beams of Spectra Diode Labs No. SDL-2430 (wave length range: 800–830 nm) were combined to adjust the output to 160 mW and used as an image writing laser.

Each of the aforementioned samples was exposed to the thus prepared laser to form an image of 22 mm×9 mm, by setting the beam diameter to 160 $\mu$m, the laser scanning speed to 0.5 m/sec (scanning center), the sample feed speed to 15 mm/sec and the scanning pitch to 8/mm. The laser energy density on the sample was 200 mJ/cm$^2$ in this case.

After carrying out scanning exposure on the samples 1 to 6 and reference samples 1 to 3 under the aforementioned laser exposure conditions, each sample was subjected to heat developing under a heating condition of 120° C. for 30 seconds to examine the resulting coloring density, and the coloring ratio was calculated by comparing the result with the coloring density at the time of the complete color development using excess acid. The results are shown in Table 1.

TABLE 1

| Sample | Coloring ratio (%) |
|---|---|
| Sample-1 (present invention) | 83 |
| Sample-2 (present invention) | 48 |
| Sample-3 (present invention) | 91 |
| Sample-4 (present invention) | 58 |
| Sample-5 (present invention) | 63 |
| Sample-6 (present invention) | 90 |
| Reference Sample-1 | 24 |
| Reference Sample-2 | 7 |
| Reference Sample-3 | 4 |

As is evident from Table 1, the samples 1 to 6 coated with leuco dyes of the present invention have high sensitivity in comparison with the reference samples 1 to 3 coated with known leuco dyes. Also, it can be seen from the results of samples 2, 4 and 5 of the present invention that they can show relatively good coloring property without adding an acid generator because of their ability to generate acidic group in the molecule by the action of heat.

Thus, as has been described in the foregoing, according to the present invention, a novel leuco dye having improved coloring property can be obtained, which can develop color by heat even with single molecule without requiring excess developer, and an image recording medium having high sensitivity and excellent resolution can be obtained by including the dye. In addition, an image recording medium capable of showing high sensitivity in an image forming method which uses an acid generator can also be obtained.

While the invention has been described in detail and with reference to specific embodiments thereof, it will be apparent to one skilled in the art that various changes and modifications can be made therein without departing from the spirit and scope thereof.

What is claimed is:

1. An image-recording medium which comprises a leuco dye represented by the following general formula (1):

$$LD—(A—P^1)^n \quad (1)$$

wherein LD represents an acid-sensitive leuco dye mother nucleus, —A represents the residue of an acidic group (—AH) selected from —$SO_3H$, —$CO_2H$ and —P(═O)$(OH)_xR^y$, R represents a hydrogen atom or a substituent group, x and y are x=1 and y=1 or x=2 and y=0, $P^1$ represents a protecting group which can be removed by the action of light, heat or acid, and n is an integer of 1 or more.

2. The image-recording medium according to claim 1, wherein LD is a spiropyran derivative.

3. The image-recording medium according to claim 1, wherein the leuco dye of general formula (1) has a polymerizable group at a substitutable position and is forming a copolymer with a monomer having a partial structure which generates acid by the action of light, heat or acid.

4. The image-recording medium according to claim 1, wherein it further comprises an acid generator which generates acid by the action of light or heat.

5. The image-recording medium according to claim 1, wherein it further comprises a compound which newly generates acid by the action of acid.

6. The image-recording medium according to claim 1, wherein it further comprises an infrared absorbing substance.

7. A leuco dye represented by the following general formula (1):

$$LD—(A—P^1)^n \quad (1)$$

wherein LD represents an acid-sensitive leuco dye mother nucleus, —A represents the residue of an acidic group (—AH) selected from —$SO_3H$, —$CO_2H$ and —P(═O)$(OH)_xR_y$, R represents a hydrogen atom or a substituent group, x and y are x=1 and y=1 or x=2 and y=0, $P^1$ represents a protecting group which can be removed by the action of light, heat or acid, and n is an integer of 1 or more.

8. The leuco dye according to claim 7, wherein LD is a spiropyran derivative.

* * * * *